US011413552B1

(12) United States Patent
Wu

(10) Patent No.: US 11,413,552 B1
(45) Date of Patent: Aug. 16, 2022

(54) BAMBOO TUBE FIGHTING TOY

(71) Applicant: Dongguan Chuangmei Industrial Design Co., Ltd., Dongguan (CN)

(72) Inventor: Minhua Wu, Dongguan (CN)

( * ) Notice: Subject to any disclaimer, the term of this patent is extended or adjusted under 35 U.S.C. 154(b) by 0 days.

(21) Appl. No.: 17/515,615

(22) Filed: Nov. 1, 2021

(51) Int. Cl.
*A63H 13/06* (2006.01)
*A63H 31/00* (2006.01)

(52) U.S. Cl.
CPC ..... *A63H 13/06* (2013.01); *A63H 31/00* (2013.01)

(58) Field of Classification Search
CPC ..... A63H 13/06
USPC ..... 446/330, 331, 332, 333, 334, 335, 336, 446/352, 357, 359, 360, 361, 362, 364, 446/365, 366, 367
See application file for complete search history.

(56) References Cited

U.S. PATENT DOCUMENTS 1,010,549 A * 12/1911 Welch ..... A63H 13/06 446/334
1,736,163 A * 11/1929 McGee ..... A63H 13/06 446/334
1,781,307 A * 11/1930 Veronda ..... A63H 13/06 446/335
1,799,735 A * 4/1931 Crowell ..... A63H 13/06 446/334
1,853,733 A * 4/1932 Lane ..... A63H 13/06 446/334
2,499,147 A * 2/1950 Meyer ..... A63H 13/06 446/334
2,586,432 A * 2/1952 Meyer ..... A63H 13/06 446/334
2,716,840 A * 9/1955 Armstrong ..... A63H 13/06 446/334
2,760,306 A * 8/1956 Pelletier ..... A63H 13/06 446/334
3,008,713 A * 11/1961 Johnson ..... A63F 9/02 446/357

(Continued)

*Primary Examiner* — Joseph B Baldori
(74) *Attorney, Agent, or Firm* — Rumit Ranjit Kanakia

(57) ABSTRACT

A novel bamboo tube fighting toy comprises a baseplate. The baseplate has an upward flange. The flange is machined with grooves on two sides. An upper housing plate is fixed above the baseplate, and the upper housing plate is provided with a first elongated slot and a second elongated slot. A movable rod penetrates through the groove and is mounted below the second elongated slot. A first sleeve, a rolling ball, a first spring and a handle are mounted at an outer end of the movable rod. A second sleeve, a collar, a second spring and a cross bar are mounted at an inner end of the movable rod. The second sleeve is connected to above the movable rod. The collar is provided at an upper part of the second sleeve. The second spring is supported between the collar and the movable rod. The cross bar is embedded at a lower part of the movable rod. A control rope is fixed on the cross bar, and is connected with a bamboo tube robot on the upper housing plate by penetrating through the second sleeve. The movable rod moves to drive the bamboo tube robot to move, and the movable rod swings to drive the bamboo tube robot to swing, thus correspondingly completing imitation of various fighting actions. The control rope is connected from the bamboo tube robot to the cross bar, such that the length of the control rope is greatly reduced. The movable rod realizes control of the bamboo tube robot by the leverage effect.

7 Claims, 4 Drawing Sheets

(56) References Cited

U.S. PATENT DOCUMENTS

| | | | | | |
|---|---|---|---|---|---|
| 3,235,259 | A * | 2/1966 | Glass | A63H 13/06 | 446/334 |
| 3,856,304 | A * | 12/1974 | Matsumoto | A63H 13/06 | 446/334 |
| 3,864,870 | A * | 2/1975 | Breslow | A63H 13/06 | 446/334 |
| 3,969,841 | A * | 7/1976 | Joseph | A63H 13/06 | 446/335 |
| 4,609,195 | A * | 9/1986 | Ham | A63H 13/06 | 446/334 |
| 5,009,424 | A * | 4/1991 | Harth | A63F 9/00 | 446/334 |
| 7,475,881 | B2 * | 1/2009 | Blagg | A63F 9/00 | 273/440.1 |
| 2022/0016537 | A1 * | 1/2022 | Vreugdenhil | A63H 3/16 | |

* cited by examiner

BAMBOO TUBE FIGHTING TOY

BACKGROUND OF THE INVENTION

1. Technical Field

The unity model relates to a novel bamboo fighting toy.

2. Description of Related Art

A bamboo tube robot is a relaxing, educational toy, usually comprising a plurality of bamboo tubes for forming body parts of the bamboo tube robot such as the head, body, arms and legs. A control rope penetrates through the bamboo tubes to connect and control each of the bamboo tubes, and the bamboo tube robot is capable of moving and completing fighting actions through movement of and traction by the control rope, which is greatly interesting. For existing bamboo tube fighting toys, the bamboo tube robot is usually formed by simply connecting several pieces of bamboo tubes, and presents little authentic fighting experience to users when completing some fighting actions. Besides, existing bamboo tube fighting toys generally have problems such as low product quality and poor operation feelings. As users increasingly pursue the product quality and the operation feelings, existing bamboo tube fighting toys face great challenges to satisfy users' actual demand, and need to be improved urgently.

BRIEF SUMMARY OF THE INVENTION

Aiming at the defects in the above-mentioned problems, the utility model provides a novel bamboo tube fighting toy.

To achieve the above objective, the unity model provides a novel bamboo tube fighting toy, including:

A baseplate, wherein the baseplate has an integrally formed upward flange, and the flange is machined with grooves on two sides;

An upper housing plate, wherein the upper housing plate is fixed above the baseplate, the upper housing plate is formed with a first elongated slot and a second elongated slot along a long-side direction, and the second elongated slot is located at each of two ends of the first elongated slot;

A movable road, wherein the movable rod penetrates through the groove and is mounted below the second elongated slots, a first sleeve, a rolling ball, a first spring and a handle are mounted at an outer end of the movable rod, the first sleeve is in a buckled connection to below the movable rod, the first spring and the rolling ball are located in the first sleeve, and the handle is fixed above the movable rod;

Wherein a second sleeve, a collar, a second spring and a cross bar are mounted at an inner end of the movable rod, the second sleeve is in a buckled connection to above the movable rod, the collar is provided at an upper part of the second sleeve, the second spring is elastically supported between the collar and the movable rod, the cross bar is embedded at a lower part of the movable rod, a control rope is fixed on the cross bar, and is connected with a bamboo tube robot on the upper housing by penetrating through the second sleeve.

The movable rod moves to drive the bamboo tube robot to move, and the movable rod swings to drive the bamboo tube robot to swing, thus correspondingly completing imitation of various fighting actions. The control rope is connected from the bamboo tube robot to the cross bar, such that the length of the control rope is greatly reduced. The movable rod realizes control of the bamboo tube robot by leverage.

As a further improvement of the solution, an end part of the baseplate is covered with a rubber pad.

In the aforementioned technical solution, the rubber pad achieves a skid-proof effect and facilitates use of the toy on desktops.

As a further improvement of the solution, a stainless-steel sheet is pressed at the position of each of the grooves.

In the aforementioned technical solution, the stainless-steel sheet helps the movable rod slide and achieves a wear resistant effect.

As a further improvement of the solution, the baseplate further has integrally formed guide plates, and the guide plates are located on two sides of the rolling ball.

In the aforementioned technical solution, the guide plates play a guiding role, ensuring that the rolling ball rolls linearly.

As a further improvement of the solution, the bamboo tube robot is comprised of an upper half body and a lower half body which are detachably connected, the lower half body is formed by penetrating the control rope through a plurality of bamboo tubes processed with a rope-through hole inside in turn, and the upper half body has a button which facilities dismantling from and assembling with the lower half body.

In the aforementioned technical solution, the bamboo tube is assembled by the upper half body and the lower half body which are detachably connected, and the upper half body actually contains no bamboo tube, such that the overall structure of the bamboo tube robot is more similar to actual human body structure.

As a further improvement of the solution, the upper half body includes a body, a left arm, a right arm and a head, and the head together with the body forms a relative rotation structure at one end and a buckled structure at the other end.

In the aforementioned technical solution, during fighting, deflection of the head is used as the judgment basis of defeat, such that the toy is adapted to turn-based games and is more interesting.

As a further improvement of the solution, the right arm is capable of rotating around the center of the right arm; the left arm is capable of moving up and down at an elbow position; the right arm holds a hammer; and, the left arm holds a knife tool.

In the aforementioned technical solution, the design of the left arm and the right arm allows the bamboo tube robot to achieve a better simulating action effect in the actual control process.

As a further improvement of the solution, the upper housing plate is further provided with a scoring device, the scoring device includes a scoring lever fixed on the upper housing plate and a slider which slides along the scoring lever, and the slider and the scoring lever have saw-tooth structures which are mutually engaged.

In the aforementioned technical solution, the scoring device is configured for turn-based scoring, and the design of the saw-tooth structure allows the slider to be positioned after movement.

Relative to the prior art, the utility model has the following beneficial effects; In the prior art, the bamboo tube robot is usually connected to the handle via the control rope, and the long-distance connection of the control rope results in a poor control effect; in the present solution, by the leverage of the movable rod, the length of the control rope is minimized to realize accurate control of the bamboo tube robot, and the bamboo tube robot is formed by assembling the upper half body and the lower half body, such that two bamboo tube robots present a very authentic fighting effect during use, so users get good experience; in addition, the novel bamboo tube fighting toy is conveniently assembled and elegantly designed, and meets market expectations.

Figure 1:
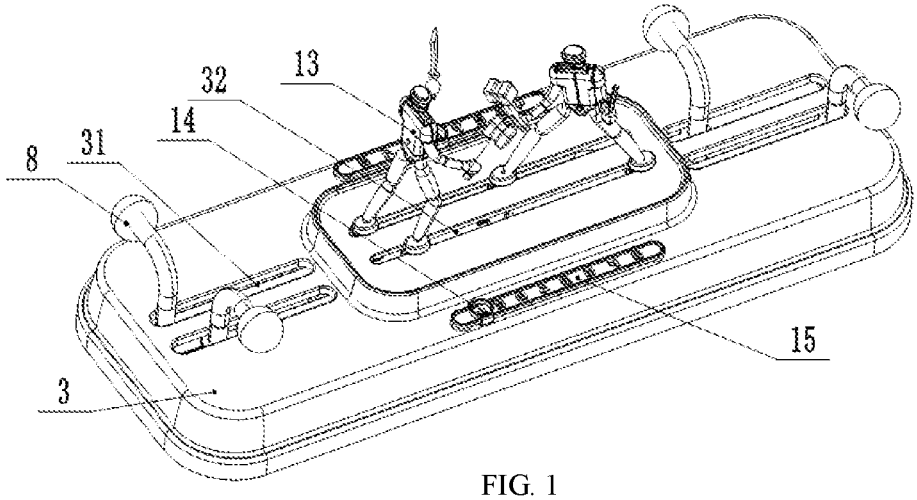
FIG. 1 is a stereogram of a novel bamboo tube fighting toy according to the utility model.

In the drawings: 1—baseplate; 1*a*—guide plate; 1*b*—flange; 1*c*—groove; 2—stainless steel sheet; 3—upper housing plate; 31—second elongated slot; 32—first elongated slot; 4—rolling ball; 5—first sleeve; 6—first spring; 7—movable rod; 8—handle; 9—cross bar; 10—second sleeve; 11—second spring; 12—collar; 13—bamboo tube; 131—upper half body; 132—button; 133—lower half body; 14—slider; 15—scoring lever, a control rope 16; a rope-through hole (17).

DETAILED DESCRIPTION OF THE INVENTION

Figure 2:
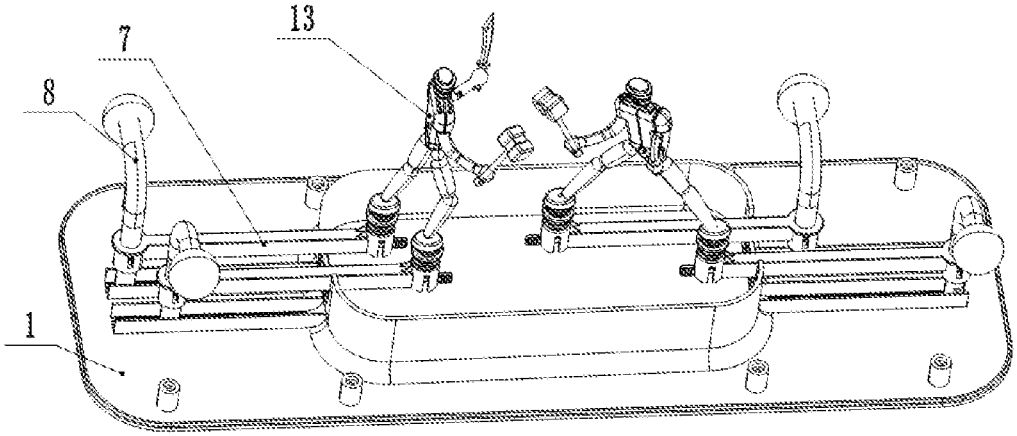
FIG. 2 is a schematic diagram of a novel bamboo tube fighting toy according to the utility model, with an upper housing plate, a slider and a scoring lever hidden.
Figure 3:
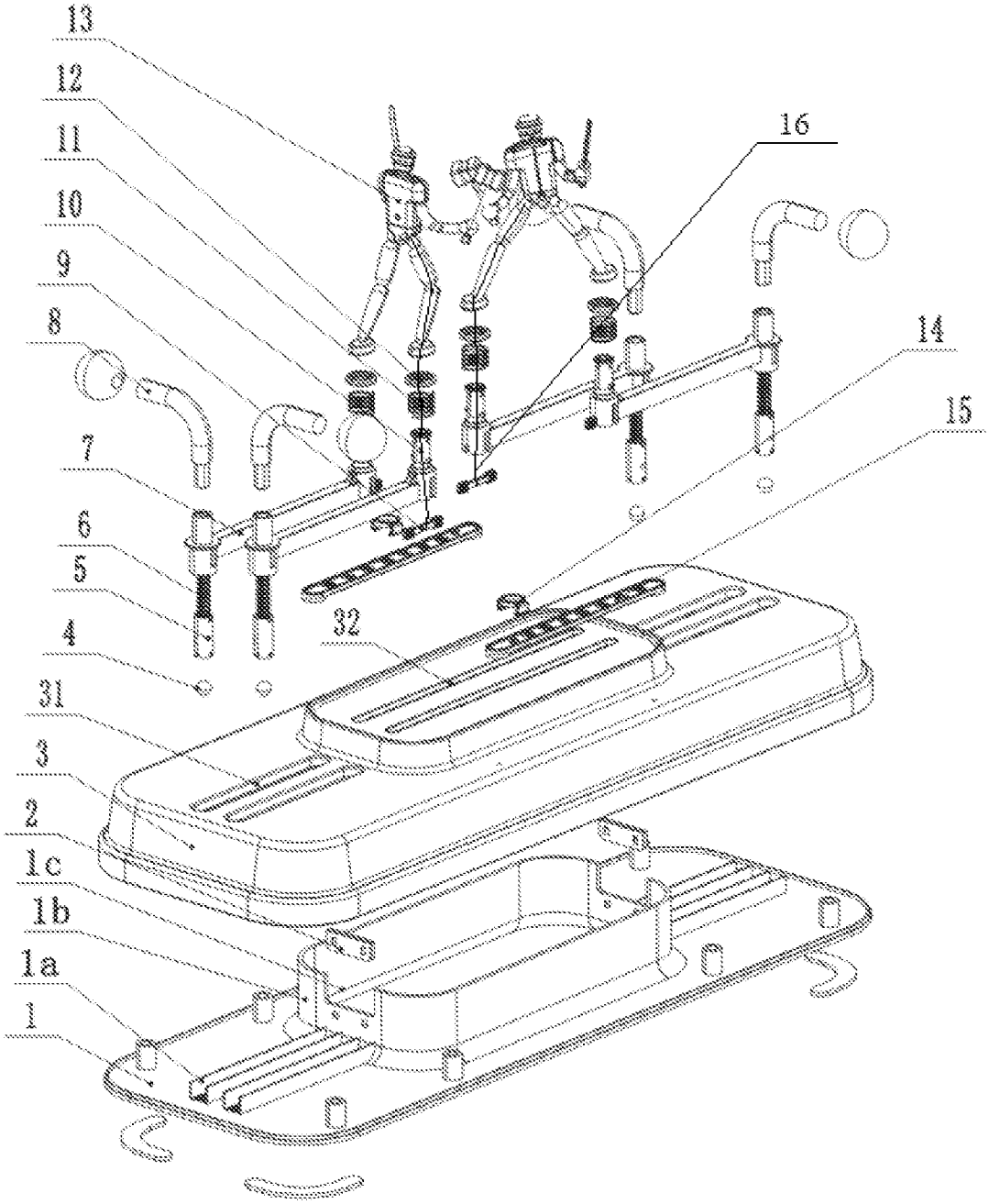
FIG. 3 is an exploded view of a novel bamboo tube fighting toy according to the utility model.
Figure 4:
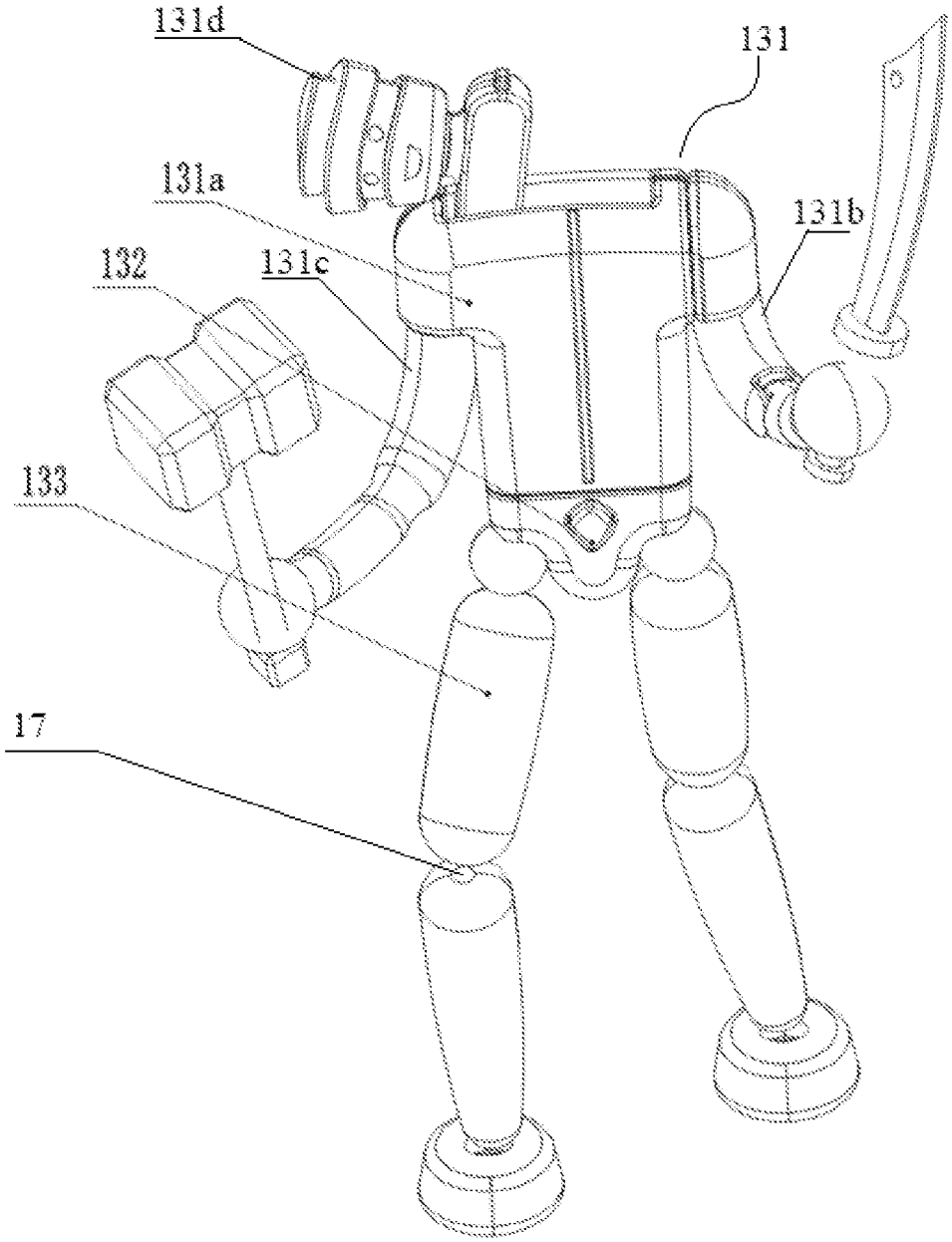
FIG. 4 is a schematic diagram of a bamboo tube robot.
Figure 5:
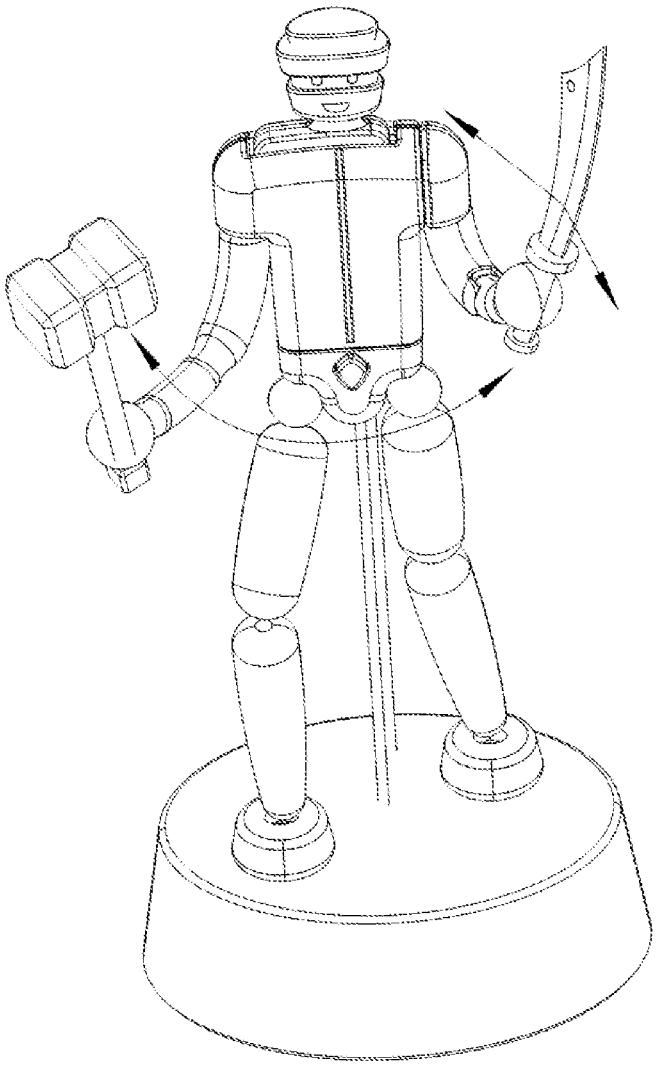
FIG. 5 is a schematic diagram of placement of the bamboo tube robot on a show shelf (the arrow in the figure indicates the movement direction of the left arm and the right arm).

As shown in FIG. 1, FIG. 2 and FIG. 3, the utility model provides a novel bamboo tube fighting toy, including a baseplate 1; the baseplate 1 has an integrally formed upward flange 1*b*, and the flange 1*b* is machined with grooves 1*c* on two sides. An upper housing plate 3 is fixed above the baseplate 1; the upper housing plate 3 is formed with a first elongated slot 32 and a second elongated slot 31 along a long-side direction; and the second elongated slot 31 is located at each of two ends of the first elongated slot 32. A movable rod 7 penetrates through the groove 1*c* and is mounted below the second elongated slots 31; a first sleeve 5, a rolling ball 4, a first spring 6 and a handle 8 are mounted at an outer end of the movable rod 7; the first sleeve 5 is in a buckled connection to below the movable rod 7; the first spring 6 and the rolling ball 4 are located in the first sleeve 5; and the handle 8 is fixed above the movable rod 7. A second sleeve 10, a collar 12, a second spring 11 and a cross bar 9 are mounted at an inner end of the movable rod 7; the second sleeve 10 is in a buckled connection to above the movable rod 7; the collar 12 is provided at an upper part of the second sleeve 10; the second spring 11 is elastically supported between the collar 12 and the movable rod 7; the cross bar 9 is embedded at a lower part of the movable rod 7; and, a control rope 16 is fixed on the cross bar 9, and is connected with a bamboo tube robot 13 on the upper housing plate 3 by penetrating through the second sleeve 10. An end part of the baseplate 1 is covered with a rubber pad, and the rubber pad achieves a skid-proof effect and facilities use of the toy on desktops. A stainless-steel sheet 2 is pressed at the position of each of the grooves 1*c*, and the stainless-steel sheet helps the movable rod slide and achieves a wear resistant effect. The baseplate 1 further has integrally formed guide plates 1*a*, and the guide plates 1*a* are located on two sides of the rolling ball 4 and play a guiding role, ensuring that the rolling ball rolls linearly. The bamboo tube robot 13 is comprised of an upper half body 131 and a lower half body 133 which are detachably connected; the lower half body 133 is formed by penetrating the control rope 16 through a plurality of bamboo tubes processed with a rope-through hole 17 inside in turn; and the upper half body 131 has a button 132 which facilitates dismantling from and assembling with the lower half body 133. The bamboo tube robot is assembled by the upper half body and the lower half body which are detachably connected, and the upper half body actually contains no bamboo tube, such that the overall structure of the bamboo tube is more similar to the actual human body structure. The upper half body 131 comprises a body (131*a*), a left arm (131*b*), a right arm (131*c*) and a head (131*d*), and the head together with the body forms a relative rotation structure at one end and a buckled structure at the other end. During fighting, the deflection of the head is used as the judgment basis of defeat, such that the toy is adapted to turn-based games and more interesting (refer to FIG. 4). The right arm is capable of rotating around the center of the right arm; the left arm is capable of moving up and down at an elbow position; the right arm holds a hammer; and the left arm holds a knife tool. The design of the left arm and the right arm allows the bamboo tube robot to achieve a better simulating action effect during actual control. The upper housing plate 3 is further provided with a scoring device; the scoring device includes a scoring lever 15 fixed on the upper housing plate 3 and a slider 14 which slides along the scoring lever 15; and, the slider 14 and the scoring lever 15 have saw-tooth structures which are mutually engaged. The scoring device is configured for turn-based scoring, and the design of the saw-tooth structure allows the slider to be positioned after movement.

In the prior art, the bamboo tube robot is usually connected to the handle via the control rope, and the long-distance connection of the control rope results in a poor control effect; in the present solution, by the leverage of the movable rod, the length of the control rope is minimized to realize accurate control of the bamboo tube robot, and the bamboo tube robot is formed by assembling the upper half body and the lower half body such that two bamboo tube robots present a very authentic fighting effect during use, so users get good experience; in addition, the novel bamboo tube fighting toy is conveniently assembled and elegantly designed, and meets market expectations.

During specific use, to facilitate understanding of the utility model, the following describes the bamboo tube fighting toy in conjunction with the attached drawings:

The toy is played by two persons standing face to face. As the handle moves along the second elongated slot 31, the rolling ball rolls between the guide plates. Under such circumstance, the feet of the bamboo tube robot move forward or backward. Pressing down the handle allows the first spring to compress and stores energy; the movable rod swings by taking the position of the stainless-steel sheet as the center; the collar compresses the second spring; and then, the control rope 16 loosens properly. Under such circumstance, the bamboo tube robot gets relaxed properly, with legs slightly bent. After the user's hand lets the handle go, the control rope 16 is tensioned again by the elastic forces of the first spring and the second spring, and then the bamboo tube robot is tightened again and stands uprightly. The combined actions of downward pressing and movement of the handle drive two bamboo tube robots to fight vigorously, which is very authentic and interesting. When the head of one of the bamboo tube robots deflects (refer to FIG.

4), the user of the bamboo tube robot with the deflecting head loses one point in the round, and the slider moves on the scoring lever to mark a point.

The above merely describes the preferred embodiments of the utility model, and shall not be construed as limiting the utility model. Those skilled in the art can make various amendments and changes to the utility model. Any amendments, equivalent substitutions, improvements, etc. that come within the spirit and principles of the present utility model are intended to be included within the scope of the utility model.

What is claimed is:

1. A novel-bamboo tube fighting toy, comprising:

a baseplate (1), wherein the baseplate (1) has an integrally formed upward flange (1*b*), and the flange (1*b*) is machined with grooves (1*c*) on two sides, the baseplate (1) further comprises guide plates (1*a*);

an upper housing plate (3), wherein the upper housing plate (3) is fixed above the baseplate (1), the upper housing plate (3) is formed with a first elongated slot (32) and a second elongated slot (31) along a long-side direction, and the second elongated slot (31) is located at each of two ends of the first elongated slot (32);

a movable rod (7), wherein the movable rod (7) penetrates through the groove (1*c*) and is mounted below the second elongated slot (31);

a first sleeve (5), a rolling ball (4), a first spring (6) and a handle (8) mounted at an outer end of the movable rod (7), wherein the first sleeve (5) is coupled to the movable rod (7), the first spring (6) and the rolling ball (4) are located in the first sleeve (5), and the handle (8) is fixed able to the movable rod (7), and;

a second sleeve (10), a collar (12), a second spring (11) and a cross bar (9) re mounted at an inner end of the movable rod (7), wherein the second sleeve (10) is coupled to the movable rod (7), the collar (12) is provided at an upper part of the second sleeve (10), the second spring (11) is elastically supported between the collar (12) and the movable rod (7), the cross bar (9) is embedded at a lower part of the movable rod (7);

a control rope (16) is fixed on the cross bar (9), and is connected with a bamboo tube robot (13) on the upper housing (3) by penetrating through the second sleeve (10), wherein the guide plates (1*a*) play a guiding role to ensure the rolling ball (4) to roll linearly when the handle (8) moves along the second elongated slot (31) to enable the bamboo tube robot (13) to move forward or backward, and wherein where the handle (8) is pressed-down, the first spring (6) is compressed and the moveable rod (7) swings upward in-turn compressing the second spring (11) via the collar (12), thereby loosening the control rope (16) fixed on the cross bar (9) to enable the bamboo tube robot to be relaxed, with legs slightly bent, and upon the handle being released, the control rope (16) fixed on the cross bar (9) is tensioned again by the elastic forces of the first spring and the second spring to enable the bamboo tube robot to be tightened and stands uprightly.

2. The bamboo tube fighting toy according to claim 1, wherein an end part of the baseplate (1) is covered by a rubber pad.

3. The bamboo tube fighting toy according to claim 1, wherein a stainless-steel sheet (2) is pressed at the position of each of the grooves (1*c*).

4. The bamboo tube fighting toy according to claim 1, wherein the guide plates (1*a*) are located on each of two sides of the rolling ball (4).

5. The bamboo tube fighting toy according to claim 1, wherein the bamboo tube robot (13) comprises:

an upper half body (131), and a lower half body (133) detachably connected to the upper half body (133), wherein the lower half body (133) comprises a rope-through hole (17) to pass the control rope (16) therethough, and the upper half body (131)has a button (132) to dismantle from and assembling with the lower half body (133).

6. The bamboo tube fighting toy according to claim 5, wherein the upper half body (131) comprises a body (131*a*), a left arm (131*b*), a right arm (131*c*) and a head (131*d*) are coupled together in moving relation with respect to each other.

7. The bamboo tube fighting toy according to claim 1, wherein the upper housing plate (3) is further provided with a scoring device, the scoring device comprises a scoring lever (15) fixed on the upper housing plate (3) and a slider (14) which slides along the scoring lever (15), and the slider (14) and the scoring lever (15) have saw-tooth structures which are mutually engaged.

* * * * *